US011730216B1

(12) United States Patent
Sun

(10) Patent No.: US 11,730,216 B1
(45) Date of Patent: Aug. 22, 2023

(54) PREPARATION METHOD OF GAUZE-CLOSURE HAIR WEFT

(71) Applicant: Jiarong Sun, Rongcheng (CN)

(72) Inventor: Jiarong Sun, Rongcheng (CN)

( * ) Notice: Subject to any disclaimer, the term of this patent is extended or adjusted under 35 U.S.C. 154(b) by 0 days.

(21) Appl. No.: 18/185,328

(22) Filed: Mar. 16, 2023

(30) Foreign Application Priority Data

Feb. 24, 2023 (CN) ..... 202310186577.5

(51) Int. Cl.
*A41G 3/00* (2006.01)

(52) U.S. Cl.
CPC ..... *A41G 3/0075* (2013.01)

(58) Field of Classification Search
CPC ..... A41G 3/0075; A41G 5/004; A41G 5/0046
See application file for complete search history.

(56) References Cited

U.S. PATENT DOCUMENTS

2013/0167858 A1* 7/2013 Lee ..... A41G 5/0066 132/54
2023/0125140 A1* 4/2023 Cao ..... A41G 5/0046 132/201

* cited by examiner

*Primary Examiner* — Rachel R Steitz

(57) ABSTRACT

A preparation method of a gauze-closure hair weft provided by the present disclosure includes: providing a hair piece and a glass panel, and laying the hair piece flat and fixing the hair piece on the glass panel; evenly applying TPU to the hair piece, and placing the glass panel into an oven and baking at 45-50° C. for three hours to obtain a hair weft strip; covering the hair weft strip with a first screen, applying TPU evenly to the hair weft strip covered with the first screen, placing the glass panel into the oven and baking at 45-50° C. for three hours; repeating the above steps to obtain a first and second single-layer hair weft; placing the second screen on the glass panel, fixing the first and second single-layer hair weft to the second screen with TPU side by side without gaps, and placing the glass panel into the oven for three hours.

6 Claims, 1 Drawing Sheet

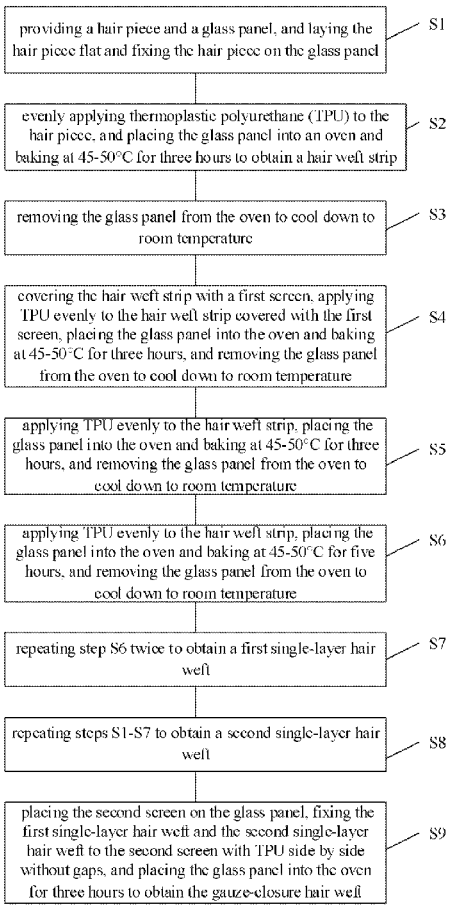

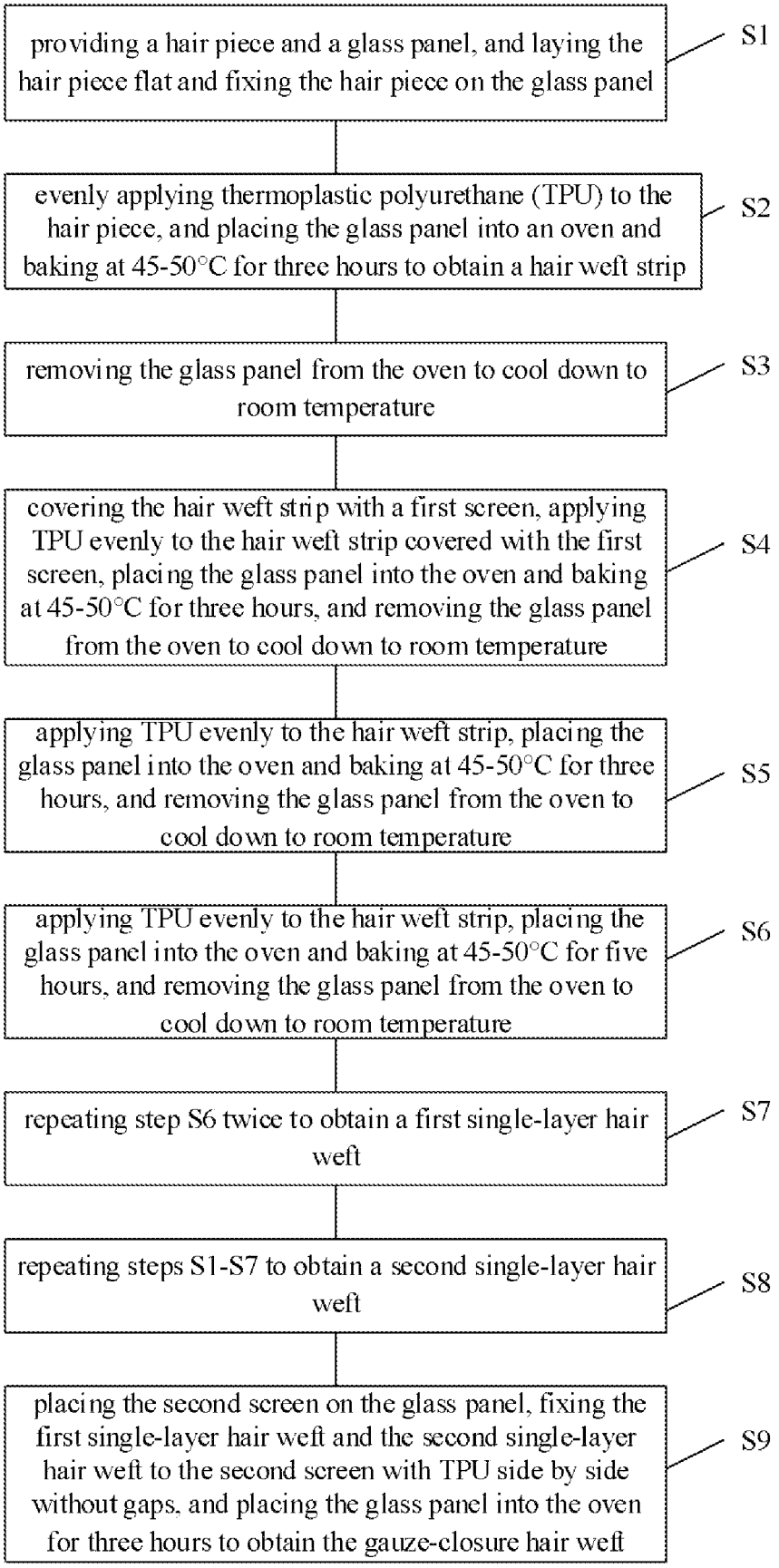
providing a hair piece and a glass panel, and laying the hair piece flat and fixing the hair piece on the glass panel
S1
evenly applying thermoplastic polyurethane (TPU) to the hair piece, and placing the glass panel into an oven and baking at 45-50°C for three hours to obtain a hair weft strip
S2
removing the glass panel from the oven to cool down to room temperature
S3
covering the hair weft strip with a first screen, applying TPU evenly to the hair weft strip covered with the first screen, placing the glass panel into the oven and baking at 45-50°C for three hours, and removing the glass panel from the oven to cool down to room temperature
S4
applying TPU evenly to the hair weft strip, placing the glass panel into the oven and baking at 45-50°C for three hours, and removing the glass panel from the oven to cool down to room temperature
S5
applying TPU evenly to the hair weft strip, placing the glass panel into the oven and baking at 45-50°C for five hours, and removing the glass panel from the oven to cool down to room temperature
S6
repeating step S6 twice to obtain a first single-layer hair weft
S7
repeating steps S1-S7 to obtain a second single-layer hair weft
S8
placing the second screen on the glass panel, fixing the first single-layer hair weft and the second single-layer hair weft to the second screen with TPU side by side without gaps, and placing the glass panel into the oven for three hours to obtain the gauze-closure hair weft
S9

PREPARATION METHOD OF GAUZE-CLOSURE HAIR WEFT

CROSS REFERENCE TO RELATED APPLICATIONS

The present application claims foreign priority of Chinese Patent Application No. 202310186577.5, filed on Feb. 24, 2023, in the China National Intellectual Property Administration, the entire contents of which are hereby incorporated by reference in its entirety.

TECHNICAL FIELD

The present disclosure relates to the technical field of wig manufacturing, in particular to a preparation method of a gauze-closure hair weft.

BACKGROUND

With the development of the economy, more and more people begin to wear hair extensions. Wearing hair extensions has the effect of appearance modification, and has advantages of simple and convenient changing hairstyles, saving time, and avoiding hair damage caused by hair perming, dyeing, and pulling. Also, the cost of doing hairstyles in the barbershop, bleaching and dyeing hair piece can be saved, which reduces expenses. Further, hairstyles can be changed at will to avoid frequent trips to the barbershop for hair styling causing damage to the hair quality. People can try a variety of hair extensions with different designs, with different fashion, which causes wearing hair extensions to become increasingly popular.

Usually, people wearing a hair extension desire a natural effect that no one around can notice a hair extension is worn. The thinner the top of the hair weft, the more natural it will look. Currently, polyurethane hair wefts are widely used because the top thickness is the thinnest.

A common polyurethane hair weft is manufactured by sticking two 1 mm-height single-layer polyurethane material layers staggered with a glue, and cutting off a protruding part on the top. The product is a double-layer polyurethane hair weft with height of 0.5 mm on the front and 1 mm on the back. However, the polyurethane material layer will crack during use, and the polyurethane surface is thicker and less comfortable to wear.

SUMMARY OF THE DISCLOSURE

Based on this, it is necessary to propose a method for manufacturing a durable and comfortable to wear hair weft.

The present disclosure provides a preparation method of a gauze-closure hair weft, comprising:

S1: providing a hair piece and a glass panel, and laying the hair piece flat and fixing the hair piece on the glass panel;

S2: evenly applying thermoplastic polyurethane (TPU) to the hair piece, and placing the glass panel into an oven and baking at 45-50° C. for three hours to obtain a hair weft strip;

S3: removing the glass panel from the oven to cool down to room temperature;

S4: covering the hair weft strip with a first screen, applying TPU evenly to the hair weft strip covered with the first screen, placing the glass panel into the oven and baking at 45-50° C. for three hours, and removing the glass panel from the oven to cool down to room temperature;

S5: applying TPU evenly to the hair weft strip, placing the glass panel into the oven and baking at 45-50° C. for three hours, and removing the glass panel from the oven to cool down to room temperature;

S6: applying TPU evenly to the hair weft strip, placing the glass panel into the oven and baking at 45-50° C. for five hours, and removing the glass panel from the oven to cool down to room temperature;

S7: repeating step S6 twice to obtain a first single-layer hair weft;

S8: repeating steps S1-S7 to obtain a second single-layer hair weft; and

S9: placing the second screen on the glass panel, fixing the first single-layer hair weft and the second single-layer hair weft to the second screen with TPU side by side without gaps, and placing the glass panel into the oven for three hours to obtain the gauze-closure hair weft.

In some embodiments, step S9 further comprises: before the fixing the first single-layer hair weft and the second single-layer hair weft to the second screen with TPU side by side without gaps, cutting the first single-layer hair weft and the second single-layer hair weft to a height of 0.4-0.5 mm respectively.

In some embodiments, step S2 further comprises: after the evenly applying TPU to the hair piece, scrapping the TPU flat with a squeegee.

In some embodiments, the method further comprises: scrapping the TPU flat with a squeegee each time the TPU is applied evenly to the hair weft strip.

In some embodiments, step S1 further comprises: before the laying the hair piece flat and fixing the hair piece on the glass panel, fixing the hair piece by sewing double stitches on the hair piece with a double stitch machine.

In some embodiments, step S1 further comprises: after the laying the hair piece flat and fixing the hair piece on the glass panel, fixing the hair piece to the glass panel with a tape.

The preparation method of a gauze-closure hair weft provided by the present disclosure includes the following steps: step S1, providing a hair piece and a glass panel, and laying the hair piece flat and fixing the hair piece on the glass panel; step S2, evenly applying thermoplastic polyurethane (TPU) to the hair piece, and placing the glass panel into an oven and baking at 45-50° C. for three hours to obtain a hair weft strip; step S3, removing the glass panel from the oven to cool down to room temperature; step S4, covering the hair weft strip with a first screen, applying TPU evenly to the hair weft strip covered with the first screen, placing the glass panel into the oven and baking at 45-50° C. for three hours, and removing the glass panel from the oven to cool down to room temperature; step S5, applying TPU evenly to the hair weft strip, placing the glass panel into the oven and baking at 45-50° C. for three hours, and removing the glass panel from the oven to cool down to room temperature; step S6, applying TPU evenly to the hair weft strip, placing the glass panel into the oven and baking at 45-50° C. for five hours, and removing the glass panel from the oven to cool down to room temperature; step S7, repeating step S6 twice to obtain a first single-layer hair weft; step S8, repeating steps S1-S7 to obtain a second single-layer hair weft; step S9, placing the second screen on the glass panel, fixing the first single-layer hair weft and the second single-layer hair weft to the second screen with TPU side by side without gaps, and placing the glass panel into the oven for three hours to obtain the gauze-closure hair weft. The present disclosure provides a preparation method of a gauze-closure hair weft, which significantly reduces the thickness of the hair weft and makes it more natural and comfortable for the user to wear, and by using the gauze-closure structure, it can reduce the phenomenon of opening and breaking of the product and greatly improve the service life of the product.

BRIEF DESCRIPTION OF THE DRAWINGS

In order to more clearly illustrate the technical solutions in the specific embodiments of the present disclosure or the related art, the following will briefly introduce the accompanying drawings that need to be used in the specific embodiments or related art. It is obvious that the attached drawings in the following description are some of the embodiments of the present disclosure. For those skilled in the art, other accompanying drawings may be obtained from these drawings without creative effort.

The sole FIGURE is a flowchart of a preparation method of a gauze-closure hair weft according to an embodiment of the present disclosure.

DETAILED DESCRIPTION

The technical solution of the present disclosure will be clearly and completely described below in conjunction with the accompanying drawings, and it is clear that the described embodiments are a part of the embodiments of the present disclosure, and not all of them. Based on the embodiments in the present disclosure, all other embodiments obtained by those skilled in the art without making creative labor fall within the scope of the present disclosure.

In the description of the disclosure, it should be noted that when terms "center", "top", "bottom", "left", "right", "vertical", "horizontal", "inner", "outer", etc. appears, the indicated orientation or positional relationship is based on the orientation or positional relationship shown in the accompanying drawings, only for the purpose of facilitating and simplifying the description of the disclosure, and not to indicate or imply that the device or element referred to must have a particular orientation, be constructed and operate in a particular orientation, and therefore cannot be construed as a limitation of the present disclosure. In addition, the terms "first", "second", "third", where they appear, are used for descriptive purposes only and are not to be construed as indicating or implying relative importance.

As shown in FIGURE, the present disclosure provides a preparation method of a gauze-closure hair weft including operations at blocks illustrated herein.

At block S1: providing a hair piece and a glass panel, and laying the hair piece flat and fixing the hair piece on the glass panel. Specifically, before laying and fixing the hair piece on the glass panel, the hair piece is fixed by sewing double stitches on the hair piece with a double stitch machine; and after laying and fixing the hair piece on the glass panel, the hair piece is fixed to the glass panel with a tape (e.g., a crepe paper) to prevent uneven smearing of the adhesive caused by the hair piece sliding in the subsequent process.

At block S2: evenly applying thermoplastic polyurethane (TPU) to the hair piece, and placing the glass panel into an oven and baking at 45-50° C. for three hours to obtain a hair weft strip. In this step, after the TPU is evenly applied to the hair piece, the TPU is scraped flat with a squeegee to eliminate air bubbles.

At block S3: removing the glass panel from the oven to cool down to room temperature.

At block S4: covering the hair weft strip with a first screen, applying TPU evenly to the hair weft strip covered with the first screen, placing the glass panel into the oven and baking at 45-50° C. for three hours, and removing the glass panel from the oven to cool down to room temperature. In this step, a squeegee is used to scrap flat the TPU as it is evenly applied to the hair weft strip. The arrangement of the first screen ensures the toughness of the hair weft strip and increases the product life.

At block S5: applying TPU evenly to the hair weft strip, placing the glass panel into the oven and baking at 45-50° C. for three hours, and removing the glass panel from the oven to cool down to room temperature.

At block S6: applying TPU evenly to the hair weft strip, placing the glass panel into the oven and baking at 45-50° C. for five hours, and removing the glass panel from the oven to cool down to room temperature.

At block S7: repeating step S6 twice to obtain a first single-layer hair weft.

At block S8: repeating steps S1-S7 to obtain a second single-layer hair weft.

At block S9: placing the second screen on the glass panel, fixing the first single-layer hair weft and the second single-layer hair weft to the second screen with TPU side by side without gaps, and placing the glass panel into the oven for three hours to obtain the gauze-closure hair weft.

Preferably, step S9 further includes: before the fixing the first single-layer hair weft and the second single-layer hair weft to the second screen with TPU side by side without gaps, cutting the first single-layer hair weft and the second single-layer hair weft to a height of 0.4-0.5 mm respectively. Compared with the common wig products on the market, the present disclosure provides a gauze-closure hair weft with a substantially reduced thickness, which can be controlled between 0.4-0.6 mm depending on the weight, amplitude, and length.

The preparation method of a gauze-closure hair weft provided by the present disclosure includes the following steps: step S1, providing a hair piece and a glass panel, and laying the hair piece flat and fixing the hair piece on the glass panel; step S2, evenly applying thermoplastic polyurethane (TPU) to the hair piece, and placing the glass panel into an oven and baking at 45-50° C. for three hours to obtain a hair weft strip; step S3, removing the glass panel from the oven to cool down to room temperature; step S4, covering the hair weft strip with a first screen, applying TPU evenly to the hair weft strip covered with the first screen, placing the glass panel into the oven and baking at 45-50° C. for three hours, and removing the glass panel from the oven to cool down to room temperature; step S5, applying TPU evenly to the hair weft strip, placing the glass panel into the oven and baking at 45-50° C. for three hours, and removing the glass panel from the oven to cool down to room temperature; step S6, applying TPU evenly to the hair weft strip, placing the glass panel into the oven and baking at 45-50° C. for five hours, and removing the glass panel from the oven to cool down to room temperature; step S7, repeating step S6 twice to obtain a first single-layer hair weft; step S8, repeating steps S1-S7 to obtain a second single-layer hair weft; step S9, placing the second screen on the glass panel, fixing the first single-layer hair weft and the second single-layer hair weft to the second screen with TPU side by side without gaps, and placing the glass panel into the oven for three hours to obtain the gauze-closure hair weft. The present disclosure provides a preparation method of a gauze-closure hair weft, which significantly reduces the thickness of the hair weft and makes it more natural and comfortable for the user to wear, and by using the gauze-closure structure, it can reduce the phenomenon of opening and breaking of the product and greatly improve the service life of the product.

The above embodiments are only intended to illustrate the technical solution of the present disclosure, not to limit it; although the present disclosure is described in detail with reference to the foregoing embodiments, it should be understood by those skilled in the art that it is still possible to modify the technical solutions recorded in the preceding embodiments, or to replace some or all of the technical features thereof; and these modifications or replacements do not make the essence of the corresponding technical solutions out of the scope of the technical solutions of the embodiments of the present disclosure.

What is claimed is:

1. A preparation method of a gauze-closure hair weft, comprising:

S1: providing a hair piece and a glass panel, and laying the hair piece flat and fixing the hair piece on the glass panel;

S2: evenly applying thermoplastic polyurethane (TPU) to the hair piece, and placing the glass panel into an oven and baking at 45-50° C. for three hours to obtain a hair weft strip;

S3: removing the glass panel from the oven to cool down to room temperature;

S4: covering the hair weft strip with a first screen, applying TPU evenly to the hair weft strip covered with the first screen, placing the glass panel into the oven and baking at 45-50° C. for three hours, and removing the glass panel from the oven to cool down to room temperature;

S5: applying TPU evenly to the hair weft strip, placing the glass panel into the oven and baking at 45-50° C. for three hours, and removing the glass panel from the oven to cool down to room temperature;

S6: applying TPU evenly to the hair weft strip, placing the glass panel into the oven and baking at 45-50° C. for five hours, and removing the glass panel from the oven to cool down to room temperature;

S7: repeating step S6 twice to obtain a first single-layer hair weft;

S8: repeating steps S1-S7 to obtain a second single-layer hair weft; and S9: placing the second screen on the glass panel, fixing the first single-layer hair weft and the second single-layer hair weft to the second screen with TPU side by side without gaps, and placing the glass panel into the oven for three hours to obtain the gauze-closure hair weft.

2. The method according to claim 1, wherein step S9 further comprises: before the fixing the first single-layer hair weft and the second single-layer hair weft to the second screen with TPU side by side without gaps, cutting the first single-layer hair weft and the second single-layer hair weft to a height of 0.4-0.5 mm respectively.

3. The method according to claim 1, wherein step S2 further comprises: after the evenly applying TPU to the hair piece, scrapping the TPU flat with a squeegee.

4. The method according to claim 1, further comprising: scrapping the TPU flat with a squeegee each time the TPU is applied evenly to the hair weft strip.

5. The method according to claim 1, wherein step S1 further comprises: before the laying the hair piece flat and fixing the hair piece on the glass panel, fixing the hair piece by sewing double stitches on the hair piece with a double stitch machine.

6. The method according to claim 1, wherein step S1 further comprises: after the laying the hair piece flat and fixing the hair piece on the glass panel, fixing the hair piece to the glass panel with a tape.

* * * * *